US007119655B2

(12) United States Patent
Starling et al.

(10) Patent No.: US 7,119,655 B2
(45) Date of Patent: Oct. 10, 2006

(54) PTC CIRCUIT PROTECTOR HAVING PARALLEL AREAS OF EFFECTIVE RESISTANCE

(75) Inventors: Jared Starling, Mansfield, OH (US); Donald G Cunitz, Mansfield, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 0 days.

(21) Appl. No.: 10/999,291

(22) Filed: Nov. 29, 2004

(65) Prior Publication Data

US 2006/0114097 A1 Jun. 1, 2006

(51) Int. Cl.
*H01C 7/10* (2006.01)

(52) U.S. Cl. ..... 338/22 R; 338/314

(58) Field of Classification Search ..... 338/22 R, 338/22 SD, 20–21, 212, 271, 275, 313–314, 338/320, 332; 219/505, 553; 361/103
See application file for complete search history.

(56) References Cited

U.S. PATENT DOCUMENTS 3,243,753 A 3/1966 Kohler
4,264,888 A 4/1981 Berg
4,314,145 A 2/1982 Horsma
4,314,230 A 2/1982 Cardinal et al.
4,330,703 A 5/1982 Horsma et al.
4,371,860 A * 2/1983 May et al. ..... 338/21
4,445,026 A 4/1984 Walker
4,486,737 A 12/1984 Ott
4,545,926 A 10/1985 Fouts, Jr. et al.
4,570,046 A 2/1986 Melanson et al.
4,582,983 A 4/1986 Midgley et al.
4,698,614 A 10/1987 Welch et al.
4,706,060 A * 11/1987 May ..... 338/20
4,717,813 A 1/1988 Berg et al.
4,766,409 A 8/1988 Mandai
4,801,784 A * 1/1989 Jensen et al. ..... 219/553
4,882,466 A * 11/1989 Friel ..... 219/505
4,907,340 A 3/1990 Fang et al.
4,924,074 A 5/1990 Fang et al.
4,967,176 A 10/1990 Horsma et al.
5,181,007 A 1/1993 Friese et al.
5,351,390 A * 10/1994 Yamada et al. ..... 29/612
5,406,246 A 4/1995 Friese et al.
5,473,304 A 12/1995 Friese et al.
5,675,307 A 10/1997 Krimm et al.
5,691,688 A 11/1997 West et al.
5,742,223 A 4/1998 Simendinger, III et al.

(Continued)

OTHER PUBLICATIONS

Polymeric PTC Manual—Printed Jun. 2003.

(Continued)

*Primary Examiner*—Tu Hoang
(74) *Attorney, Agent, or Firm*—Harness, Dickey & Pierce, P.L.C.

(57) ABSTRACT

A PTC circuit protection device to protect electronic devices against excessive temperatures and electrical currents. The device comprises a polymeric resistor element, a first electrode, and a second electrode. The polymeric resistor element changes resistance in response to temperature changes. The resistor element has an upper surface and a lower surface. The first electrode is in electrical contact with both the upper surface and the lower surface. The second electrode is in electrical contact with both the upper surface and the lower surface. The circuit protection device has a first effective area of resistance and a second effective area of resistance that is electrically in parallel with the first effective area.

28 Claims, 10 Drawing Sheets

U.S. PATENT DOCUMENTS

| | | | | |
|---|---|---|---|---|
| 5,777,541 | A * | 7/1998 | Vekeman | |
| 5,852,397 | A | 12/1998 | Chan et al. | |
| 5,864,281 | A | 1/1999 | Zhang et al. | |
| 5,990,778 | A | 11/1999 | Strümpler et al. | |
| 6,133,819 | A | 10/2000 | Comberg et al. | |
| 6,188,308 | B1 | 2/2001 | Kojima et al. | |
| 6,211,771 | B1 | 4/2001 | Zhang et al. | |
| 6,215,388 | B1 | 4/2001 | West | |
| 6,373,684 | B1 | 4/2002 | Tanida et al. | |
| 6,556,123 | B1 * | 4/2003 | Iwao et al. | 338/22 R |
| 6,606,023 | B1 * | 8/2003 | Chiang et al. | 338/22 R |
| 2002/0070842 | A1 | 6/2002 | Heaney | |
| 2002/0125982 | A1 * | 9/2002 | Swensen et al. | 338/22 R |
| 2003/0227368 | A1 * | 12/2003 | Huang et al. | 338/22 R |
| 2003/0227731 | A1 * | 12/2003 | Huang et al. | 338/22 R |
| 2004/0027230 | A1 * | 2/2004 | Chaing et al. | 338/22 R |
| 2004/0108936 | A1 | 6/2004 | Han et al. | |
| 2005/0057338 | A1 * | 3/2005 | Han et al. | 338/22 R |
| 2005/0062581 | A1 * | 3/2005 | Koyama | 338/22 R |

OTHER PUBLICATIONS

Therm-O-Disc Bulletin No. 51K-54K-593—Printed 1993.
Therm-O-Disc Midwest Components Product Group Catalog—Printed Jan. 1997.

* cited by examiner

FIG 1
PRIOR
ART
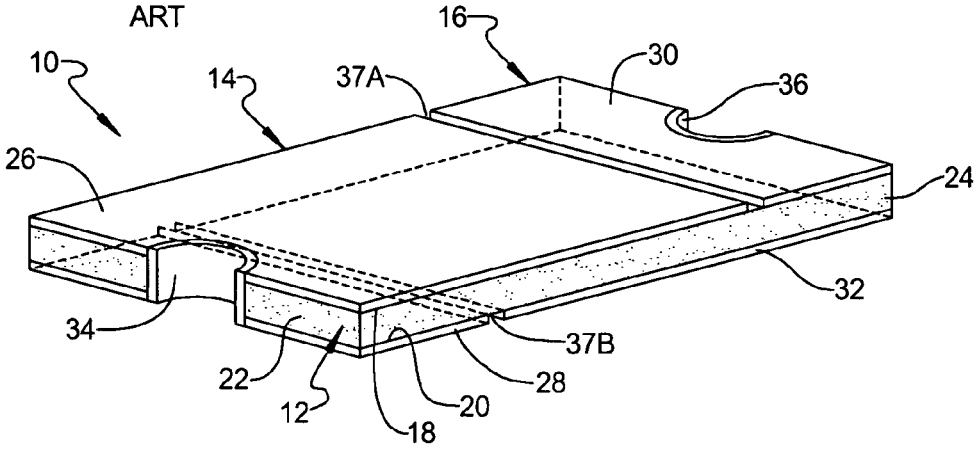
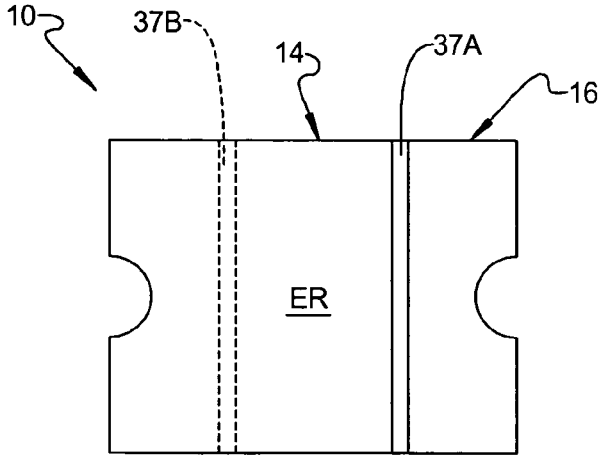
FIG 2
PRIOR
ART
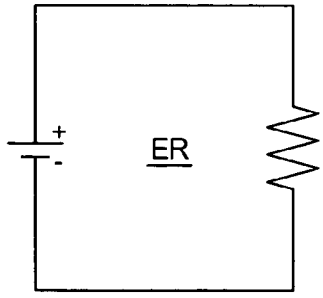
FIG 3
PRIOR
ART

FIG 4
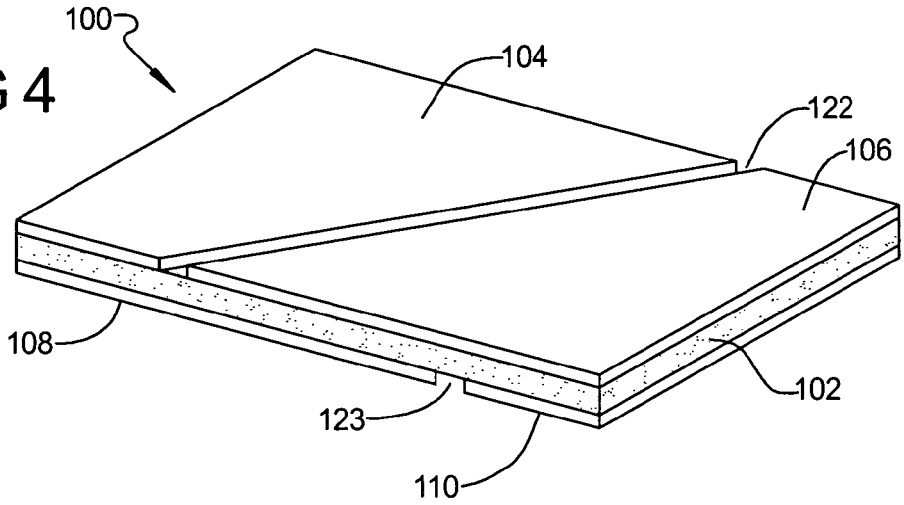
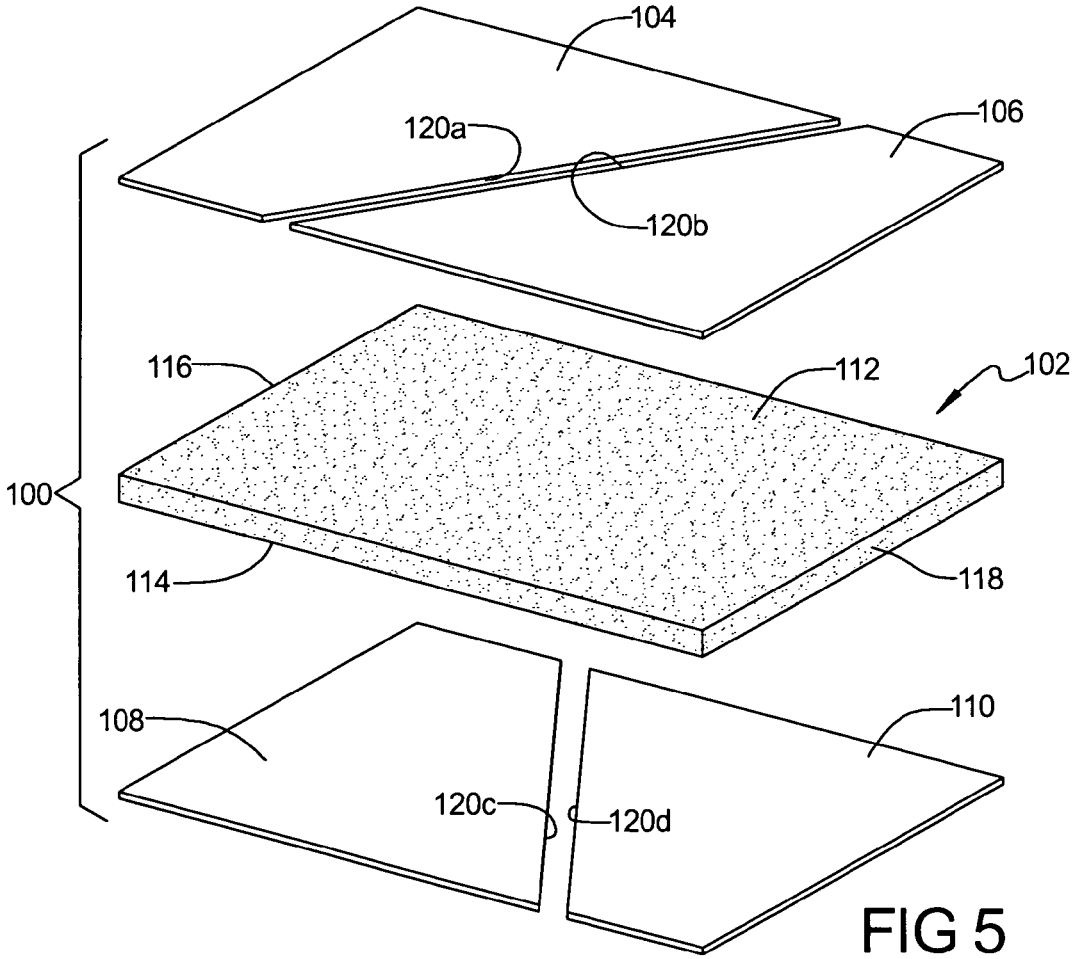
FIG 5

PTC CIRCUIT PROTECTOR HAVING PARALLEL AREAS OF EFFECTIVE RESISTANCE

FIELD OF THE INVENTION

The present invention relates to circuit protection devices. In particular, the present invention relates to polymeric positive temperature coefficient (PTC) of resistance circuit protection devices.

BACKGROUND OF THE INVENTION

A circuit protector having a positive temperature coefficient of resistance is commonly referred to as a PTC device and the specific material that provides the resistance characteristic is commonly referred to as a PTC material or a PTC resistor element. PTC devices are commonly employed in a variety of different electronic devices, such as electric motors, to protect the device against over current and/or excessive temperature conditions.

The PTC device is typically positioned within the current path that supplies power to the protected device such that the current must pass through the resistor element of the PTC device before the current reaches the protected device. Under normal operating temperatures and currents, the resistor element exhibits a relatively low resistance to current and permits the substantially unimpeded flow of current to the protected device. When the current or the environmental temperatures become excessive, the resistivity of the PTC device increases to at least substantially restrict the amount of current delivered to the protected device to prevent the protected device from being damaged.

The resistor element is typically a polymeric resistor element that has a homogeneous mixture of polyolefin material and conductive carbon particles. At normal operating temperatures and currents, the resistor element has a crystalline structure, which provides a low-resistance conductive path device. When excessive temperatures and/or currents are encountered, the resistor element undergoes a phase change (switching action) to an amorphous (non-crystalline) structure and an expansion of the polyolefin. The phase change inhibits conductivity by separating the carbon black particles and results in an increased resistance. The phase change occurs in a very narrow temperature band, resulting in a rapid increase in the resistance of several orders of magnitude. The high resistance state limits current flow to the protected device and protects the device from being damaged by excessive current and/or temperatures. After the excessive temperature and/or current ceases, the resistor element returns to its low-resistance state. The resistor element can be brought to its phase change temperature by self-induced $I^2R$ heating or by exposure to an elevated temperature in the surrounding environment.

Even when the PTC device is operating in its low-resistance state under normal operating conditions, the PTC device inhibits, to some extent, current flow to the protected device. Therefore, due to the presence of the PTC device, additional current is required to power the protected device than would otherwise be required in the absence of the PTC device. To conserve energy, it is desirable that the resistance of the resistor element be as low as possible under normal operating currents and temperatures. While the resistivity of conventional PTC devices at standard operating conditions is low enough to provide PTC devices that are suitable for their intended purposes, there is a need for a PTC device having an even lower resistance at normal operating conditions to decrease the amount of current needed to operate the protected device and to therefore conserve energy.

Under normal operating conditions, the overall resistance (Ω) of the PTC device is a function of the resistor element's thickness (t), resistor element area of effective resistance (A) (its length (l) multiplied by its width (w)) and resistivity (ρ), which is a property inherent to the composition of the particular resistor element. Specifically, under normal operating conditions the overall resistance of the PTC device can be calculated by the following equation:

$$\Omega=(t/A)(\rho), \text{ where } A=w*l.$$

The resistor element area of effective resistance is the portion of the resistor element through which current actually passes and is, therefore, the portion of the resistor element that actually provides a resistance to the current. The greater the area of effective resistance (A), the lower the overall resistance (Ω) of the PTC device. Further, it is a well established property that resistors electrically connected in parallel have a lower resistance than resistors connected in series. Therefore, PTC devices having multiple resistor elements in parallel have a lower resistance under normal operating conditions than PTC devices having multiple resistor elements in series.

While PTC devices having a decreased resistance under normal operating conditions can be obtained by increasing the resistor element's area of effective resistance, there exists a competing need to keep the overall dimensions of the PTC device as small as possible to enable the PTC device to be used in applications where space is at a premium. The present invention fulfills the need for a PTC device having a decreased resistance under normal operating conditions by providing PTC devices that each have multiple resistor elements in parallel and an enlarged area of effective resistance as compared to conventional PTC devices. A plurality of the improved PTC devices can be provided together in parallel in a PTC assembly that has a resistance under normal operating conditions that is lower than the resistance of any of the improved PTC devices alone.

An understanding of conventional PTC devices allows one to better appreciate the features of the current invention. FIG. 1 illustrates an exemplary PTC device at 10. The conventional PTC device 10 generally includes a polymeric PTC resistor element 12, a first electrode 14, and a second electrode 16. The resistor element 12 generally includes an upper surface 18, a lower surface 20, a first end 22, and a second end 24. The first electrode 14 has a first portion 26 and a second portion 28. The second electrode 16 generally includes a first portion 30 and a second portion 32. The first portions 26 and 30 and the second portions 28 and 32 are positioned on opposite sides of the resistor element 12.

The first portion 26 of the first electrode 14 is positioned on or closely adjacent to the upper surface 18 of the resistor element 12 and the second portion 28 of the first electrode 14 is positioned on or closely adjacent to the lower surface 20 of the first electrode 14. The first portion 26 and the second portion 28 are electrically connected by a first side electrode 34. The first side electrode 34 spans the thickness of the resistor element 12 at the first end 22.

The first portion 30 of the second electrode 16 is positioned on or closely adjacent to the upper surface 18 of the resistor element 12 and the second portion 32 of the second electrode 16 is positioned on or closely adjacent to the lower surface 20 of the resistor element 12. The first portion 30 and the second portion 32 are electrically connected by a second side electrode 36. The second side electrode 36 spans the width of the resistor element 12 at the second end 24.

The first electrode 14 is positioned such that the first portion 26 opposes the second portion 28 on the opposite side of the PTC element 12. Similarly, the second portion 32 of the second electrode 16 is positioned such that it opposes the first portion 30. The first portion 26 of the first electrode 14 and the second portion 32 of the second electrode 16 extend beyond the second portion 28 and the first portion 30 respectively toward the center of the device 10 and overlap at the center of the device 10. The first electrode 14 and the second electrode 16 are separated by skive marks or gaps 37A and 37B.

With additional reference to FIGS. 2 and 3, when electrical contact is made at any point on the first electrode 14 and the second electrode 16 and electrical current is supplied to the electrodes 14,16, current passes between the electrodes 14,16 through the resistor element 12 in the region ER where the electrodes 12,14 overlap. The region ER is the area of effective resistance of the PTC device 10. As illustrated, the area of effective resistance ER of the resistor element 12 is much smaller than the overall area of the element 12 and the resistance of the device 10 at normal operating conditions is greater than it would be if the area of effective resistance ER of the element 12 was increased. Further, as illustrated in FIG. 3 where the area of effective resistance ER is illustrated in a circuit diagram, the PTC device 10 only has a single area of effective resistance ER, thus causing the PTC device 10 to have a greater resistance under normal operating conditions than it would otherwise have if the resistor element 12 was divided into multiple areas of effective resistance electrically in parallel.

Thus, there is a need for an improved PTC device that exhibits a reduced resistance under normal operating conditions as compared to the conventional PTC devices, such as the PTC device 10.

SUMMARY OF THE INVENTION

The present invention provides for PTC circuit protection devices to protect electronic devices against excessive temperatures and electric currents. The PTC devices have a lower resistance at normal operating temperatures and currents than conventional PTC devices. The decreased resistance is realized because the PTC devices have resistor elements with multiple areas of effective resistance that are electrically in parallel. The decreased resistance also results from the PTC devices having an increased area of effective resistance, but not an increased overall size. The present invention also provides for PTC assemblies that combine a plurality of the improved PTC devices electrically in parallel to form PTC assemblies having a resistance under normal operating conditions that is lower than any of the resistances of the individual PTC devices.

In one embodiment, the device comprises a polymeric resistor element, a first electrode, and a second electrode. The polymeric resistor element changes resistance in response to temperature changes. The resistor element has a first surface and a second surface. The first electrode is in electrical contact with the first surface. The second electrode is in electrical contact with the second surface. The first electrode and the second electrode are in electrical connection with each other across the polymeric resistor element. The resistor element has a first area of effective resistance and a second area of effective resistance, the first area of effective resistance electrically in parallel with the second area of effective resistance.

The invention further provides for a circuit protection device comprising a polymeric resistor element, a first electrode, and a second electrode. The polymeric resistor element changes resistance in response to temperature changes and has an upper surface, a lower surface, a first end, and a second end opposite the first end. The first electrode has a first portion in electrical contact with the upper surface and a second portion in electrical contact with the lower surface. The second electrode has a third portion in electrical contact with the lower surface and a fourth portion in electrical contact with the upper surface. The first portion of the first electrode opposes and is in electrical contact with the first portion of the second electrode. The second portion of the first electrode opposes and is in electrical contact with the second portion of the second electrode. The first and the second portions of the first electrode are electrically connected by a first side electrode positioned between the first end and the second end of the resistor element. The first and the second portions of the second electrode are electrically connected by a second side electrode positioned between the first end and the second end of the resistor element.

The present invention also provides for a circuit protection device comprising a polymeric resistor element, a first electrode, a second electrode, a third electrode, and a fourth electrode. The polymeric resistor element changes resistance in response to temperature changes. The resistor element has an upper surface and a lower surface. The first electrode is in electrical contact with the upper surface. The second electrode is in electrical contact with the upper surface. The third electrode is in electrical contact with the lower surface. The fourth electrode is in electrical contact with the lower surface. The first electrode is shaped to overlap and make electrical contact with both the third electrode and the fourth electrode. The second electrode is shaped to overlap and make electrical contact with both the third electrode and the fourth electrode. The circuit protection device has a first effective area of resistance and a second effective area of resistance that is electrically in parallel with the first effective area of resistance.

The invention also provides for a method for producing a circuit protection device. The method comprises the steps of: forming a polymeric resistor element that changes resistance in response to environmental changes and has an upper surface and a lower surface; positioning a first electrode in electrical contact with the upper surface and the lower surface; and positioning a second electrode in electrical contact with the upper surface and the lower surface. As such, the resistor element conducts electricity through a first effective resistance area and a second effective resistance area that is electrically in parallel with the first effective resistance area.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a perspective view of one prior art PTC device;

FIG. 2 is a plan view of the PTC device of FIG. 1;

FIG. 3 is a schematic diagram of the area of effective resistance of the PTC device of FIG. 1;

FIG. 4 is a perspective view of a PTC device according to an embodiment of the present invention;

FIG. 5 is an exploded view of the PTC device of FIG. 4;

DETAILED DESCRIPTION OF THE PREFERRED EMBODIMENTS

Figure 6:
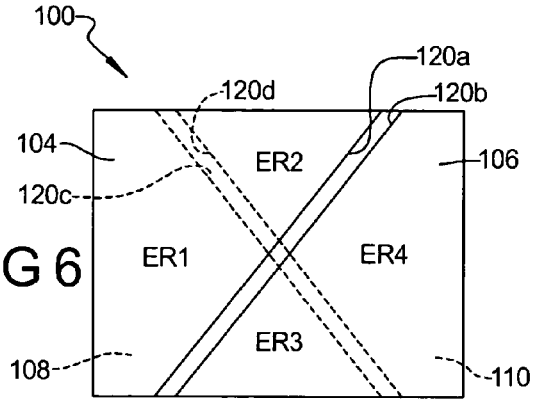
FIG. 6 is a plan view of the PTC device of FIG. 4.

The following description of the preferred embodiments is merely exemplary in nature and is in no way intended to limit the invention, its application, or uses.

With initial reference to FIGS. 4 through 7, a positive temperature coefficient (PTC) circuit protection device according to an embodiment of the present invention is illustrated at reference numeral 100. The PTC device 100 generally includes a polymeric resistor element 102, a first electrode 104, a second electrode 106, a third electrode 108, and a fourth electrode 110.

The resistor element 102 can comprise a homogeneous mixture of polyolefin material and carbon black particles. For example, the resistor element 102 can be manufactured from high density polyethylene and carbon black. While the resistor element 102 is illustrated as having a rectangular shape, the resistor element 102 can be various different shapes and sizes. In some applications, the resistor element 102 has a thickness that is preferably less than 0.05 of an inch and usually less than 0.02 of an inch. The resistor element 102 generally includes an upper surface 112, a lower surface 114, a first end 116, and a second end 118.

At normal operating temperatures and currents, the resistor element 102 generally has a crystalline structure, which provides a low-resistance conductive path between the electrodes 104, 106, 108, and 110. When the resistor element 102 experiences elevated temperatures caused by, for example self-induced $I^2R$ heating or increased ambient temperatures, the resistor element 102 undergoes a phase change to an amorphous structure. During this phase change, the polyolefin expands and the distance between the carbon black particles increases reducing the conductivity of, and conversely increasing the resistance of, the resistor element 102. The phase change occurs in a very narrow temperature band such as 122° C. to 128° C., resulting in a rapid increase in the resistance of several orders of magnitude. The exact temperature at which the phase change occurs depends on the type of polyolefin and carbon particles chosen for the composition of the resistor element 102.

In many applications, the resistor element 102 has a phase change temperature that is not less than 80° C., although it will be appreciated that the phase change temperature can be at temperatures other than 80° C. At the phase change temperature, the resistance of the resistor element 102 rapidly increases at least several orders of magnitude. In some applications, the resistance of the resistor element 102 rapidly increases at the phase change temperature to at least approximately $10^3$ times its resistance at 25° C. For example, if resistance of the resistor element 102 at 25° C. is approximately 100 ohm-centimeters, then its resistance at the phase change temperature would be 100,000 ohm-centimeters. Between 25° C. and the phase change temperature, the resistivity does not deviate significantly from its value at 25° C.

The first electrode 104, the second electrode 106, the third electrode 108, and the fourth electrode 110 are each of a similar shape and type, but are orientated about the resistor element 102 differently. The electrodes 104, 106, 108, and 110 can be manufactured from any suitable material, but are typically nickel-coated copper foil electrodes.

As illustrated in the assembled view of FIG. 4, the first electrode 104 extends from the first end 116 of the resistor element 102 and across a portion of the resistor element 102 where the first electrode 104 terminates at angled portion 120*a*. Similarly, the second electrode 106 extends from the second end 118 of the resistor element 102 and across a portion of the resistor element 102 where the second electrode 106 terminates in an angled portion 120*b*. The angled portions 120*a* and 120*b* are parallel to each other and separated by a first gap or skive mark 122.

As most clearly illustrated in the exploded view of FIG. 5, the third electrode 108 and the fourth electrode 110 are arranged in an orientation that is opposite to the first and second electrodes 104 and 106, e.g. rotated 180° about the horizontal. The third electrode 108 extends from the first end 116 of the resistor element 102 and across a portion of the resistor element 102 where the third electrode 108 terminates at angled portion 120*c*. Similarly, the fourth electrode 110 extends from the second end 118 of the resistor element 102 where the fourth electrode 110 terminates at angled portion 120*d*. The angled portions 120*c* and 120*d* are parallel to each other and separated by a second skive mark 123. As illustrated in the plan view of FIG. 6, the electrodes 104, 106, 108, and 110 are orientated such that the angled portions 120*a* and 120*b* generally form an "X" in plan view with the angled portions 120*c* and 120*d*.

The PTC device 100 is placed in a circuit in series between a power source and the device to be protected by the PTC device 100 such that current from the power source passes through the PTC device 100 before reaching the device protected by the PTC device 100. The PTC device 100 can be connected at any two of the first electrode 104, the second electrode 106, the third electrode 108, and the fourth electrode 110.

With specific reference to the plan view of FIG. 6, the resistor element 102 has four areas of effective resistance ER1, ER2, ER3, and ER4 that provide resistance to current supplied by a power source 124. The areas of effective resistance ER1–ER4 correspond to areas of overlap between the electrodes 104–110. Specifically, effective resistance ER1 is located in the region of the resistor element 102 where the first electrode 104 opposes the third electrode 108. The effective resistance ER2 is located in the region of the resistor element 102 where the first electrode 104 opposes the fourth electrode 110. The effective resistance ER3 is located in the region of the resistor element 102 between the second electrode 106 and the third electrode 108. The effective resistance ER4 is located in the region of the resistor element 102 between the second electrode 106 and the fourth electrode 110.

Figure 7:
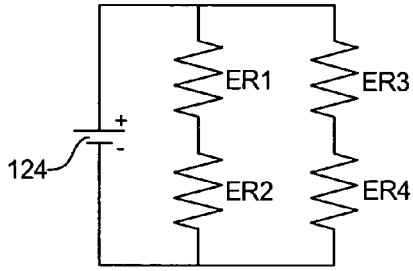
FIG. 7 is a schematic diagram of the area of effective resistance of the PTC device of FIG. 4.

With specific reference to FIG. 7, the areas of effective resistance ER1–ER4 are illustrated schematically. When the PTC device 100 is connected to the power source 124 at the third electrode 108 and the fourth electrode 110, the area of effective resistance ER1 is in series with the area of effective resistance ER2 and the area of effective resistance ER3 is in series with the area of effective resistance ER4. The areas of effective resistance ER1 and ER2 are in parallel with the areas ER3 and ER4 because the shape and orientation of the electrodes 104, 106, 108, and 110 is such that multiple paths are present between multiple electrodes. Specifically, the first electrode 104 is in electrical contact with both the third electrode 108 and the fourth electrode 110 and the second electrode 106 is in electrical contact with both the third electrode 108 and the fourth electrode 110.

The PTC device 100 provides numerous advantages over prior art PTC circuit protection devices. The overall resistance of the device 100 can be lowered by reducing the size of the areas of effective resistance that are in series, ER2 and ER3, by, for example, changing the shape, size, and/or orientation of the electrodes 104–110 and then decreasing the resistance in effective resistance areas ER2 and ER3 to minimize the influence of these areas. The resistance of the resistor element 102 in the areas of effective resistance ER2 and ER3 can be lowered or eliminated in numerous different ways. For example, the resistance of the resistor element 102 in the area of effective resistance ER2 can be eliminated or greatly reduced by directly connecting the first electrode 104 to the fourth electrode 110 in the area of ER2 by plating or through a wire connection. Similarly, the resistance of the resistor element 102 in the area of effective resistance ER3 can be eliminated or greatly reduced by directly connecting the second electrode 106 to the third electrode 108 in the area of ER3 by plating or through a wire connection.

In addition to the configuration of the PTC device 100 described above, various additional embodiments of the device 100 are encompassed by the invention. For example, the electrodes 104–110 can be shaped and in a variety of different ways in addition to the design described above so long as the first electrode 104 is positioned opposite to the third and the fourth electrodes 108 and 110 and as long as the second electrode 106 is positioned opposite to the third electrode 108 and the fourth electrode 110. Further, the electrodes 104, 106, 108, and 110 can include terminals (not shown) that are connected to the electrodes 104, 106, 108, and 110 to facilitate connection between the electrodes 104–110 and the power source 112. Still further, multiple devices 100 can be combined in parallel to provide an assembly having even a lower resistance under normal operating conditions. The devices 100 can be combined in parallel in any suitable manner. For example, multiple devices 100 can be secured directly to each other in parallel and/or can be combined in parallel about a terminal, similar to assembly 500 described below (see FIG. 16).

With additional reference to FIGS. 8 through 11, a PTC device according to another embodiment of the present invention is illustrated at reference numeral 200. At set forth below, the PTC device 200 has a resistance at normal operating conditions that is lower than conventional PTC devices and the PTC device 100 because its two areas of effective resistance are electrically in parallel with each other and with a power source.

The PTC device 200 generally includes a polymeric PTC resistor element 202, a first electrode 204, and a second electrode 206. The resistor element 202 generally includes an upper surface 208, a lower surface 210, a first end 212, and a second end 214. The resistor element 202 is substantially similar to the resistor element 102 described above and, therefore, the above description of the resistor element 102 equally applies to the resistor element 202. The first electrode 204 generally includes a first portion 216 and a second portion 218. The second electrode 206 generally includes a first portion 220 and a second portion 222.

The first portion 216 of the first electrode 204 is positioned directly on or in electrical contact with the upper surface 208 of the resistor element 202 at the first end 212 of the resistor element 202. The second portion 218 of the first electrode 204 is positioned directly on or in electrical contact with the lower surface 210 of the resistor element 202 at the second end 214 of the resistor element 202. The first portion 216 and the second portion 218 are electrically connected by a first side electrode 226. The first side electrode 226 is a conductive plate that extends between the upper surface 208 and the lower surface 210 of the resistor element 202. The first side electrode 226 is positioned approximately halfway between the first end 212 and the second end 214 within a first recess 228 of a first side portion 230 of the resistor element 202. The first side electrode 226 can be integral with the first portion 216 and the second portion 218 of the first electrode 204 or it can be a separate conductive piece that is placed in conductive contact with both the first portion 216 and the second portion 218.

The second electrode 206 has a shape that is substantially similar to the first electrode 204 and is orientated about the resistor element 202 in a manner that is substantially similar to, but the reverse of, the orientation of the first electrode 204. Specifically, the first portion 220 of the second electrode 206 is positioned directly on or in electrical contact with the upper surface 208 of the resistor element 202 at the second end 214 of the resistor element 202. The second portion 222 of the second electrode 206 is positioned directly on or in electrical contact with the lower surface 210 of the resistor element 202 at the first end 212 of the resistor element 202. The first portion 220 and the second portion 222 are electrically connected by a second side plate 232 (FIG. 5B). The second side plate 232 is similar to the first side electrode 226 and is a conductive plate that extends between the upper surface 208 and the lower surface 210 of the resistor element 202. The second side plate 232 is positioned approximately halfway between the first end 212 and the second end 214 and within a second recess 234 of a second side portion 236 of the resistor element 202. The second side plate 232 can be integral with the first portion 220 and the second portion 222 or it can be a separate conductive piece that is placed in conductive contact with both the first and second portions 220 and 222.

The first portion 216 of the first electrode 204 is separated from the first portion 220 of the second electrode 206 on the upper surface of the resistor element 202 by a first gap or skive mark 240. Similarly, the second portion 222 of the second electrode 206 is separated from the second portion 218 of the first electrode 204 at the lower surface 210 of the resistor element 202 by a second gap or skive mark 242.

Figure 10:
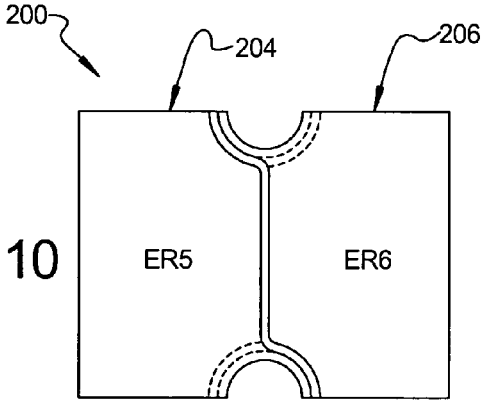
FIG. 10 is a plan view of the PTC device of FIG. 8.
Figure 11:
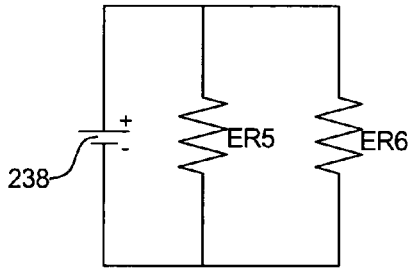
FIG. 11 is a schematic diagram of areas of effective resistance of the PTC device of FIG. 8.

With additional reference to FIGS. 10 and 11, electrical contact is made between a power source 238 and the PTC device 200 at the terminals 204 and 206 to transfer electrical current to the PTC device 200 and through the resistor element 202. The overlapping orientation of the first and second electrodes 204 and 206 about the resistor element 202 results in the formation of two areas of effective resistance ER5 and ER6 within the resistor element 202. It is at these two areas of effective resistance ER5 and ER6 that current passes through the resistor element 202. The area of effective resistance ER5 is formed in the portion of the resistor element 202 positioned between the first portion 216 of the first electrode 204 and the second portion 222 of the second electrode 206. The area of effective resistance ER6 is formed in the portion of the resistor element 202 positioned between the first portion 220 of the second electrode and the second portion 218 of the first electrode 204.

As illustrated in the schematic diagram of FIG. 11, the two effective areas of resistance ER5 and ER6 are electrically in parallel with each other. The parallel resistance between the areas of effective resistance ER5 and ER6 is due to the orientation of the electrodes 204 and 206 about the resistor element 202. Specifically, the parallel resistance is provided by the cross over of the electrodes 204 and 206 between the upper and lower sides 208 and 210 of the PTC element 202 and because both of the electrodes 204 and 206 extend the entire length of the resistor element 202.

Various modifications to the device 200 are also within the scope of the present invention. For example, the first and second electrodes 204 and 206 can be of a variety of different shapes and sizes, as long as each of the first and second electrodes 204 and 206 are in electrical contact with both the upper surface 208 and the lower surface 210 of the PTC resistor element 202 and as long as the first portion 216 of the first electrode 204 opposes the second portion 222 of the second electrode 206 and the first portion 220 of the second electrode 206 opposes the second portion 218 of the first electrode 204. Further, each of the first and second electrodes 204 and 206 can include terminals (not shown) to facilitate connection with the power source 238. Still further, multiple devices 200 can be combined in parallel to provide an assembly having even a lower resistance. The devices 100 can be combined in parallel in any suitable manner. For example, multiple devices 100 can be secured directly to each other in parallel and/or combined in parallel about a terminal, similar to assembly 500 described below.

With additional reference to FIGS. 12–15, a PTC circuit protection device according to an additional embodiment of the present invention is illustrated at reference numeral 300. The device 300 generally includes a polymeric PTC resistor element 302, a first electrode 304, and a second electrode 306. The device 300 is similar to the device 200, except that the shape and/or design of the first and second electrodes 304 and 306 differs from the shape and/or design of the electrodes 204 and 206. Like the PTC device 200, the PTC device 300 includes two areas of effective resistance in parallel that encompass the majority of the resistor element 302 to decrease the overall resistance of the PTC device 300 under normal operating conditions as compared to the resistance of conventional PTC devices.

The polymeric resistor element 302 generally includes an upper surface 308, a lower surface 310, a first end 312, a second end 313 opposite the first end 312, a first side 316, and a second side 318. The resistor element 302 is substantially similar to the resistor element 102. Therefore, the above description of the resistor element 102 equally applies to the resistor element 302.

The first electrode 304 generally includes a first portion 320 and a second portion 322. The first portion 320 is positioned directly on or in electrical contact with the upper surface 308 of the resistor element 302. The first portion 320 extends along the second end 313 and the second side 318 of the upper surface 308 in a generally "L" shaped manner. The second portion 322 is positioned directly on or in electrical contact with the lower surface 310 of the resistor element 302 and extends across a portion of the lower surface 310 near the first side 316 and the first end 312 of the resistor element 302.

The first portion 320 and the second portion 322 are electrically connected by a first side electrode 324. The first side electrode 324 is a conductive plate that extends between the upper surface 308 and the lower surface 310 of the resistor element 302. The first side electrode 324 is positioned within a first recess 326 of the first end 312 of the resistor element 302. The first side electrode 324 can be integral with the first portion 320 and the second portion 322 or it can be a separate conductive piece that is placed in conductive contact with both the first portion 320 and the second portion 322.

The second electrode 306 has a shape that is substantially similar to the shape of the first electrode 304 and is orientated about the resistor element 302 in a manner that is substantially similar to, but the reverse of, the orientation of the first electrode 304. Specifically, the second electrode 306 generally includes a first portion 328 and a second portion 330. The first portion 328 is positioned directly on or in electrical contact with the upper surface 308 of the resistor element 302. The first portion 328 extends along a portion of the upper surface 308 of the resistor element 302 from the first end 312 to near the second electrode 306. The first portion 328 is bordered by the first portion 320 of the first electrode 304 and is separated from the first portion 320 by a first gap or skive mark 332.

The second portion 330 of the second electrode 306 is positioned directly on or in electrical contact with the lower surface 310 of the resistor element 302. The second portion 330 extends along the second end 313 and the second side 318 of the lower surface 310 in a generally "L" shaped manner. The second portion 330 is separated from the second portion 322 by a second skive mark 334.

The first portion 328 and the second portion 330 of the second electrode 306 are electrically connected by a second side electrode 336. The second side electrode 336 is a conductive plate that extends between the upper surface 308 and the lower surface 310 of the resistor element 302. The second side electrode 336 is positioned along the first side 316 of the resistor element 302. The second side electrode 336 is seated within a second recess 338 of the first side 316 of the resistor element 302. The second side electrode 336 can be integral with the first portion 328 and the second portion 330 or the second side electrode 336 can be a separate conductive piece that is positioned in conductive contact with both the first portion 328 and the second portion 330.

Figure 14:
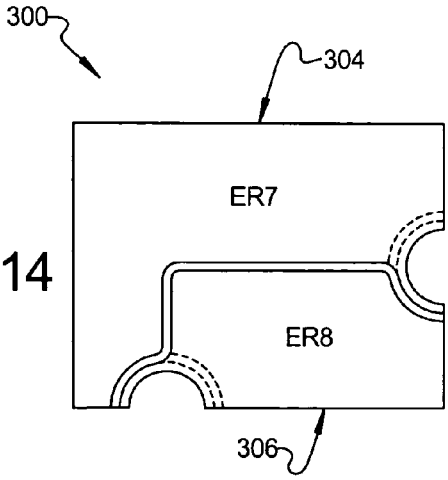
FIG. 14 is a plan view of the PTC device of FIG. 13.
Figure 15:
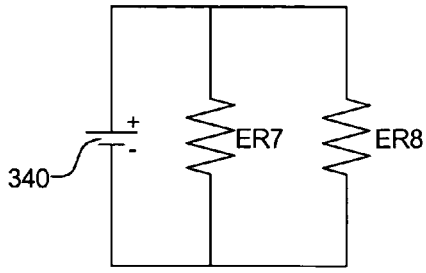
FIG. 15 is a schematic diagram of areas of effective resistance of the PTC device of FIG. 12.
Figure 8:
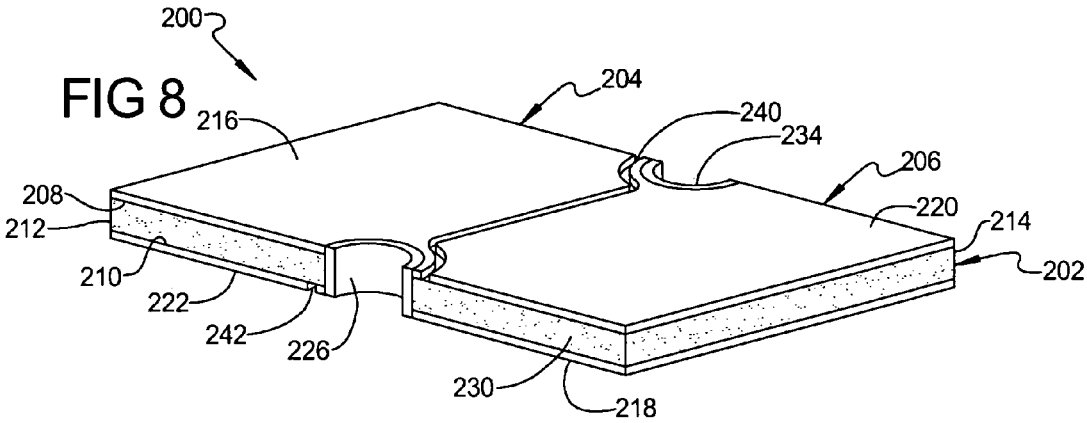
FIG. 8 is a perspective view of a PTC device according to another embodiment of the present invention.
Figure 9:
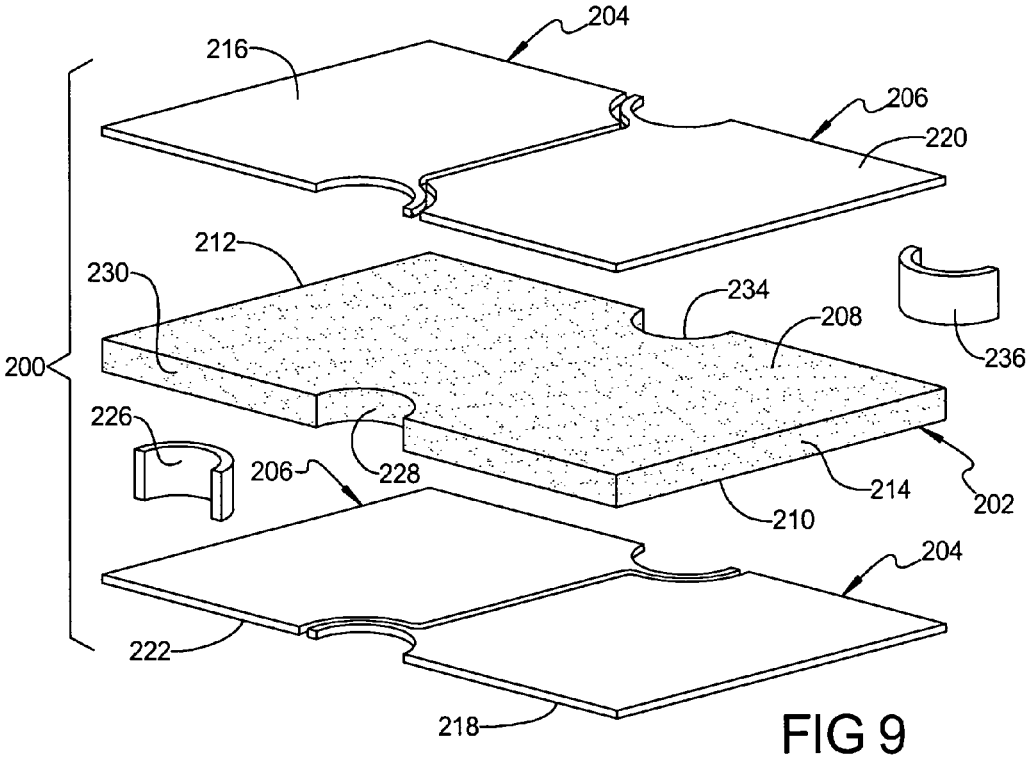
FIG. 9 is an exploded view of the PTC device of FIG. 8.
Figure 12:
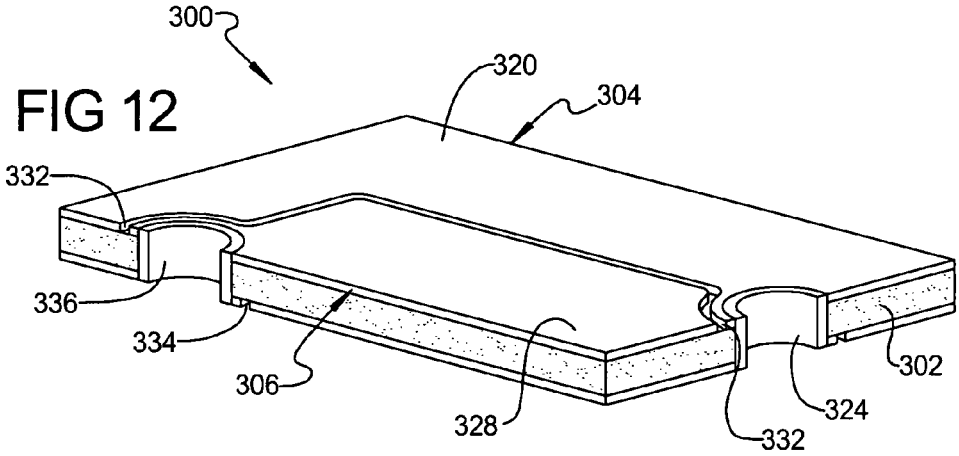
FIG. 12 is a perspective view of a PTC device according to an additional embodiment of the present invention.
Figure 13:
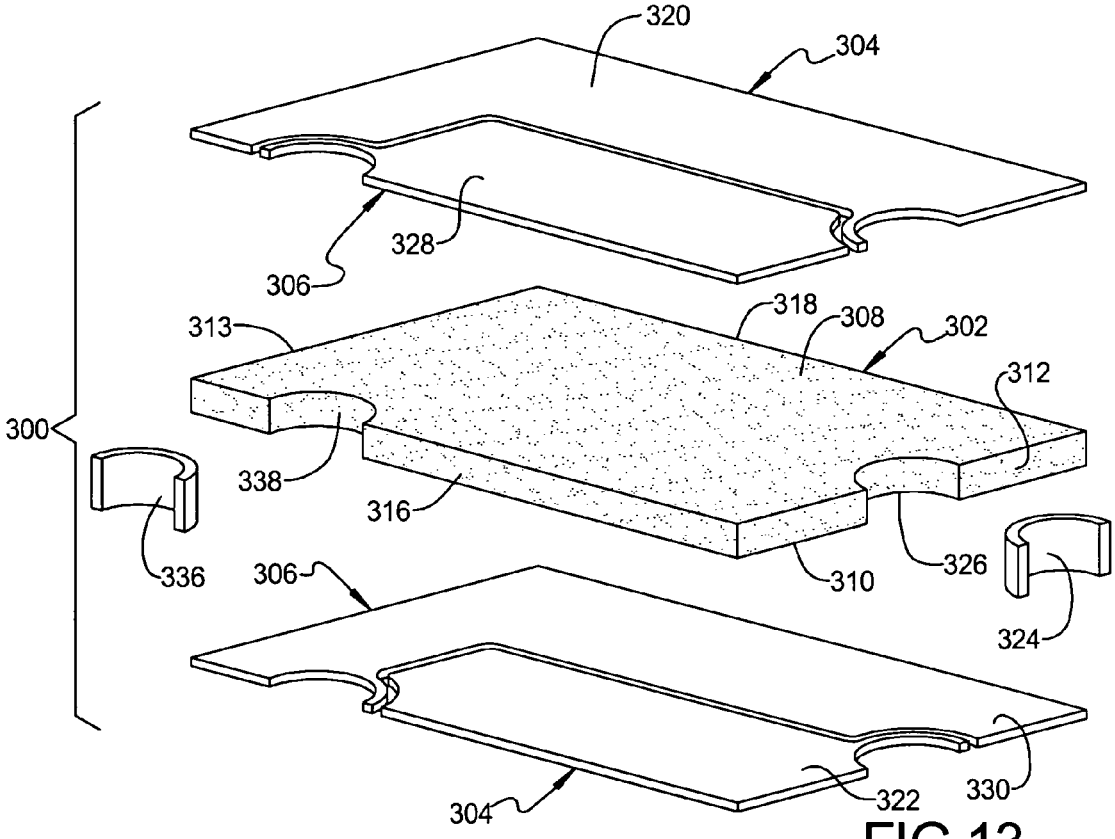
FIG. 13 is an exploded view of the PTC device of FIG. 12.

With particular reference to FIGS. 14 and 15, electrical contact is made between a power source 340 and the PTC device 300 at the terminals 304 and 306 to transfer electrical current to the PTC device 300 and through resistor element 302. The overlapping orientation of the first and second electrodes 304 and 306 about the resistor element 302 results in the formation of two areas of effective resistance ER7 and ER8. It is at these two areas of effective resistance ER7 and ER8 that current passes through the resistor element 302. The area of effective resistance ER7 is formed in the portion of the resistor element 302 positioned between the first portion 320 of the first electrode 304 and the second portion 330 of the second electrode 306. The area of effective resistance ER8 is formed in the portion of the resistor element 302 between the second portion 322 of the first electrode 304 and the first portion 328 of the second electrode 306.

As illustrated in the schematic diagram of FIG. 15, the two effective areas of resistance ER7 and ER8 are electrically in parallel with each other. The parallel resistance between the areas of effective resistance ER7 and ER8 is due to the orientation of the electrodes 304 and 306 about the resistor element 302. Specifically, the parallel resistance is provided by the cross over of the electrodes 304 and 306 between the upper and lower sides 308 and 310 of the resistor element 302 and because both of the electrodes 304 and 306 extend the entire length of the resistor element 302.

Various modifications to the device 300 are also within the scope of the present invention. For example, the first and second electrodes 304 and 306 can be of a variety of different shapes and sizes, as long as each of the first and second electrodes 304 and 306 are in electrical contact with both the upper surface 308 and the lower surface 310 of the resistor element 302 and as long as the first portion 320 of the first electrode 304 opposes the second portion 330 of the second electrode 306 and the first portion 328 of the second electrode 306 opposes the second portion 322 of the first electrode 304. Further, each of the first and second electrodes 304 and 306 can include terminals (not shown) to facilitate connection with the power source 340.

Figure 16:
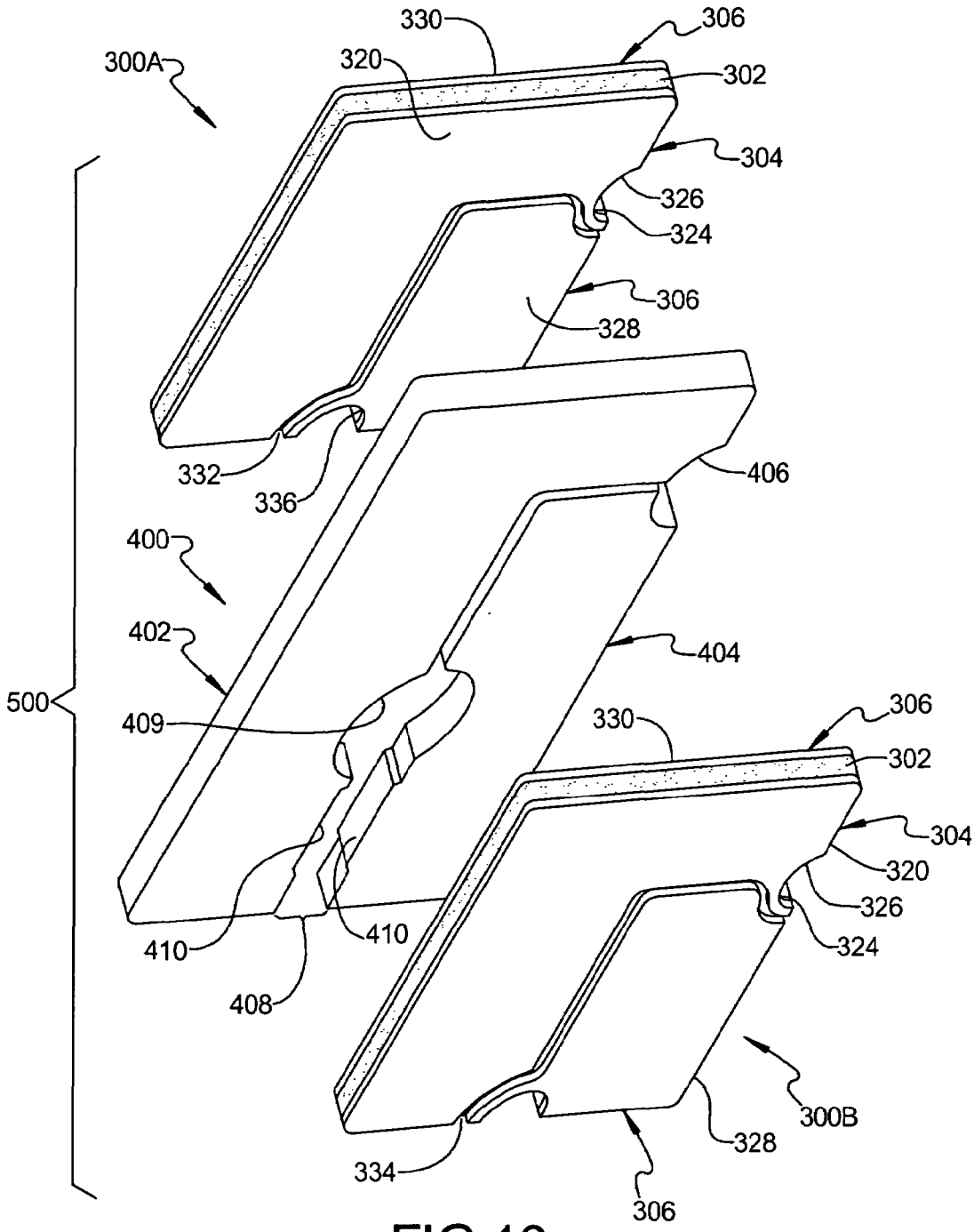
FIG. 16 is a disassembled view of a PTC assembly according to an embodiment of the present invention.

With additional reference to FIG. 16, two PTC devices 300A and 300B, which are each identical to the PTC device 300, can be combined and mounted on a terminal plate 400 to produce a multiple chip PTC, or stacked PTC, circuit protector assembly 500. As set forth below, the assembly 500 has a lower resistance under normal operating conditions than a single PTC device 300 because the two PTC devices 300A and 300B are combined in parallel. Further, the terminal plate 400 facilitates connection of the assembly 500 with the device to be protected or along the current path between a power source and the device to be protected.

The terminal 400 includes a first terminal portion 402 and a second terminal portion 404. The first terminal portion 402 has an "L" shape that approximates the shape of the first portion 320 of the first electrode 304 and the second portion 330 of the second electrode 306. The first terminal portion 402 includes a terminal recess 406 that is wider than the first recess 326 of the PTC device 300. The second terminal portion 404 has a shape that approximates the shape of the first portion 328 of the second electrode 306 and the second portion 322 of the first electrode 304.

The first terminal portion 402 and the second terminal portion 404 are offset from each other to define a space or slit 408 between the first and second terminal portions 402 and 404. In the region of the terminal 400 covered by the circuit protection devices 300, the slit 408 is sized and shaped to approximate the size and shape of the first and second skive marks 332/334. In the region of the terminal 400 not covered by the circuit protection devices 300, the terminal 400 includes a circular opening 409 defined by indents in the first terminal portion 402 and the second terminal portion 404. Details 410 in the first and second terminal portions 402 and 404 define additional features in the slit 408. The details 410 and the opening 409 can facilitate cooperation between the terminal 400 and the electrical device to be protected in some applications. The terminal 400 can be made of any suitable electrically conductive material, such as copper or brass.

Figure 17:
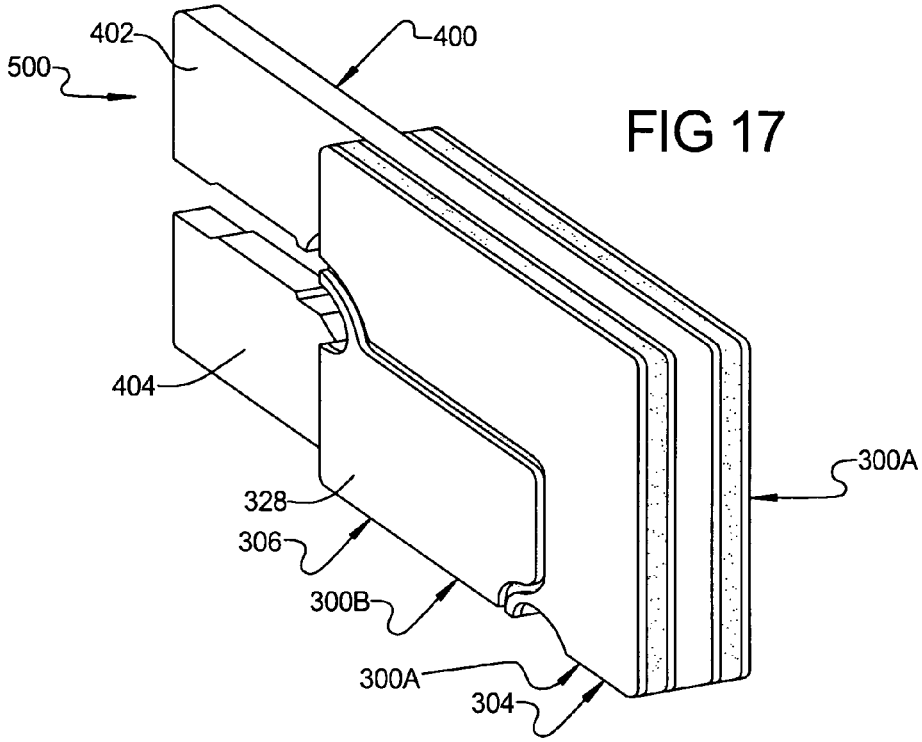
FIG. 17 is an assembled view of the PTC assembly of FIG. 16.
Figure 18:
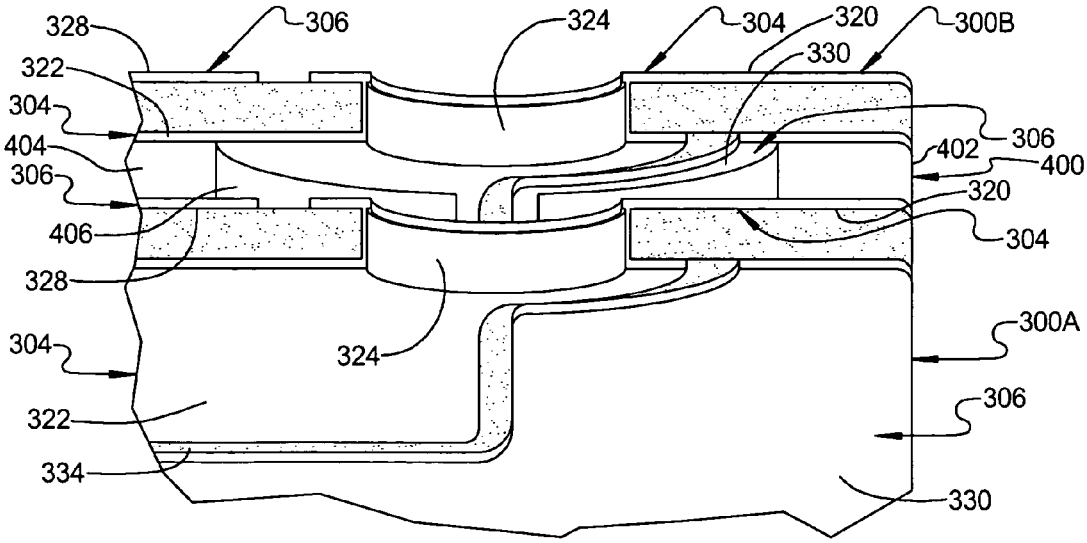
FIG. 18 is illustrates the PTC assembly of FIG. 16 in additional detail.

FIGS. 17 and 18 illustrate the assembly 500 as assembled. The PTC device 300A is orientated such that the first portion 320 of the first electrode 304 is in electrical contact with the first terminal portion 402 of the terminal 400 and the first portion 328 of the second electrode 306 is in electrical contact with the second terminal portion 404 of the terminal 400. The circuit protection device 300B is orientated such that the second portion 330 of the second electrode 306 is in electrical contact with the first terminal portion 402 of the terminal 400 and the second portion 322 of the first electrode 304 is in contact with the second terminal portion 404 of the terminal 400.

Electrical current is provided to the circuit protection devices 300A and 300B through the terminal 400, which makes electrical contact with a power source at the first terminal portion 402 and the second terminal portion 404. The circuit protection devices 300A and 300B are electrically in parallel due to their position and orientation on the terminal 400. Because the devices 300A and 300B are in parallel, the overall resistance of the assembly 500 at normal operating temperatures is approximately one-half the resistance of a PTC device 300 having a resistor element of the same dimensions.

Additional PTC devices 300 can be secured to one or both of the PTC devices 300A and 300B to provide three or more PTC devices 300 in parallel and to further decrease the overall resistance of the assembly 500 at normal operating temperatures. For example, if the assembly 500 has three PTC devices 300, the overall resistance of the assembly 500 is approximately one-third the resistance of the single PTC device 300 and if the assembly 500 has four PTC devices 300 the overall resistance of the assembly 500 is approximately one-fourth the resistance of the single PTC device 300, etc. Preferably, when two PTC devices 300 are stacked directly on top of each other, the device 300 that is not directly secured to the terminal 400, but rather to another device 300, is slightly modified so that the second skive marks 334 of the two adjacent devices 300 are at least substantially aligned with each other.

Figure 19:
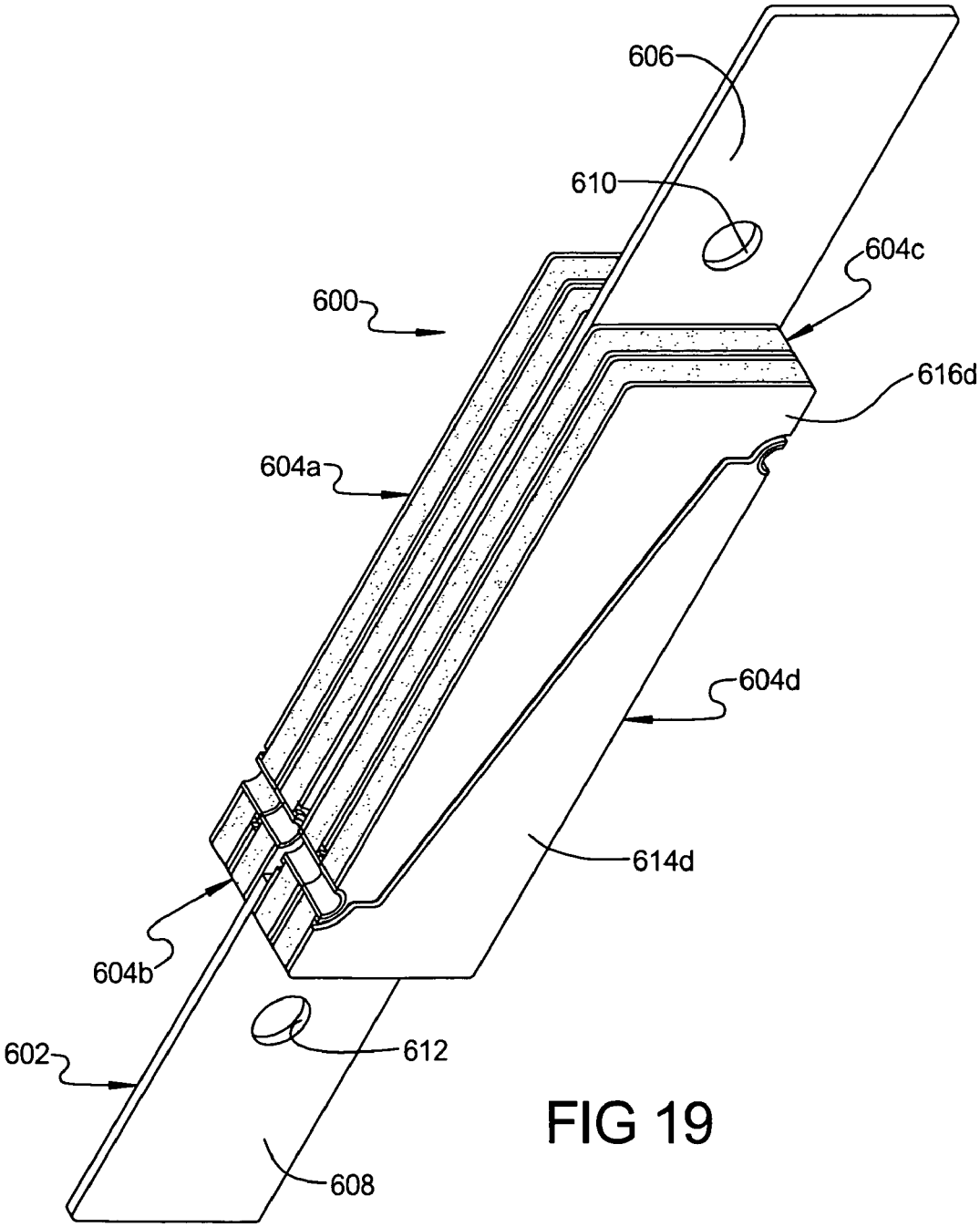
FIG. 19 is a perspective view of a PTC assembly according to another embodiment of the present invention.
Figure 20:
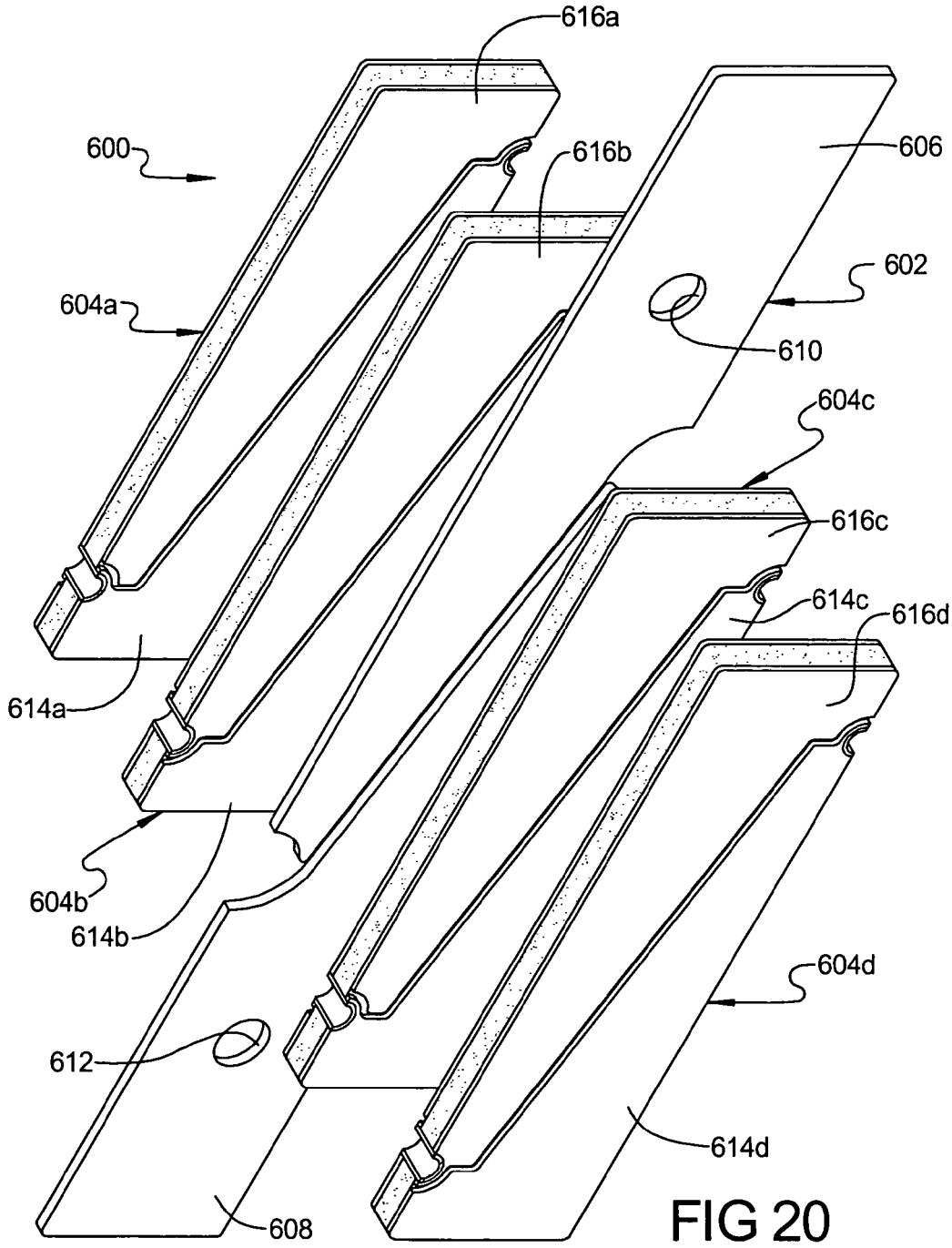
FIG. 20 is a disassembled view of the PTC assembly of FIG. 19.
Figure 21:
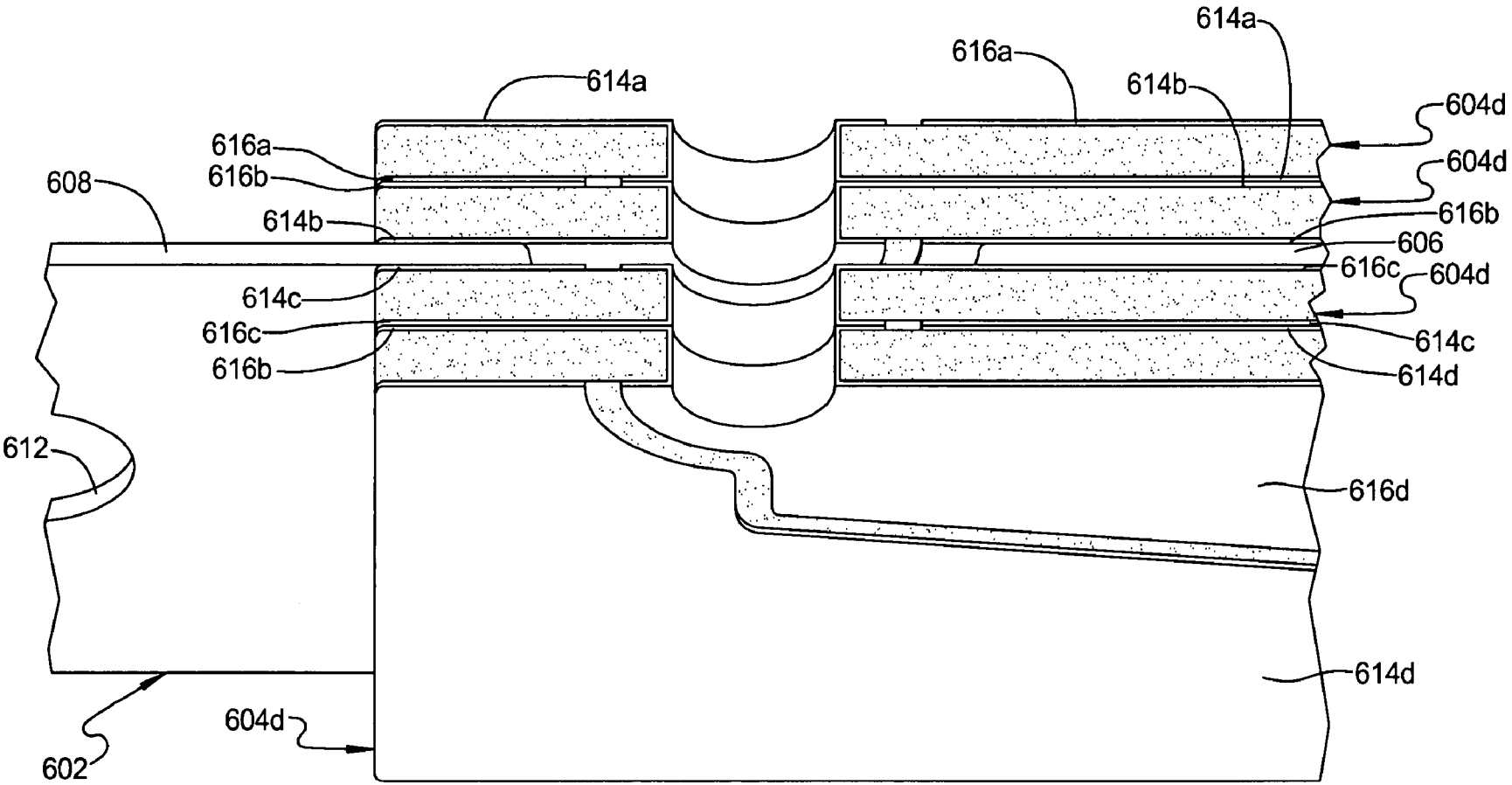
FIG. 21 illustrates the PTC assembly of FIG. 19 is additional detail.

FIGS. 19, 20, and 21 illustrate another multiple chip PTC device, or stacked PTC device, assembly at 600 according to a further embodiment of the present invention. The assembly 600 includes multiple PTC devices 604. Advantageously, the assembly 600 has a lower resistance under normal operating conditions then a single conventional PTC device because the multiple PTC devices 604 are combined in parallel and have areas of effective resistance that encompass the majority of the resistor element.

The assembly 600 generally includes a terminal 602, and four circuit protection devices 604A, 604B, 604C, and 604D. The terminal 602 includes a first terminal portion 606 and a second terminal portion 608. The first terminal portion 606 includes a first through hole 610 and the second terminal portion 608 includes a second through hole 612. The first and second terminal portions 606 and 608 are not integral but spaced apart.

The PTC devices 604A–604D each include a first electrode 614A–614D, respectively, and a second electrode 616A–616D, respectively. The electrodes 614A–D and 616A–D are separated by skive marks 618A–D respectively. The PTC devices 604 are substantially similar to the circuit protection device 300. The only substantial difference between the PTC devices 604 and the PTC devices 300 is that the shape of the electrodes 614,616 of the PTC devices 604 differs from the shape of the electrodes 304,306 of the protection device 300, as illustrated in the drawing figures.

The PTC devices 604 are orientated such that the second electrode 616B of the second PTC device 604B and the first electrode 614C of the third PTC device 604C are in electrical contact with opposite sides of the first terminal portion 606. Further, the first electrode 614B of the PTC device 604B and the second electrode 616C of the third PTC device 604C are in electrical contact with the second terminal portion 608. The skive mark 618A' is at least substantially aligned with the skive mark 618B and the skive mark 618C' is substantially aligned with the skive mark 618D.

The assembly 600 can be used in a variety of applications, but is particularly suited for use as a battery protector. Electrical contact between the assembly 600 and the device to be protected, such as a battery, is made at both the first terminal portion 606 and the second terminal portion 608. Like the PTC device 300, the position and configuration of the first and second electrodes 614/616 provides each of the PTC devices 604 with two effective areas of resistance in the resistive element that are in parallel, thus decreasing the resistance of each individual PTC device 604 at normal operating temperatures. The combination of multiple devices 604 about the terminal 602 in the configuration set forth above places the PTC devices 604 in parallel with each other to decrease the overall resistance of the assembly 600 at normal operating temperatures.

The PTC devices 100, 200, 300, 500, and 600 can be manufactured using a variety of conventional processes, devices, and techniques. For example, the PTC device 100 is often manufactured by a process that can also be used to manufacture multiple PTC devices 100. Specifically, the resistor element 102 is first extruded or pressed between two sheets of a conductive metal, such as nickel-coated copper foil. Areas of the foil are then removed or skived in the region of gaps 122 and 123 of the device 100 using any suitable technique, such as mechanical or chemical etching to define the electrodes 104–110. One or more individual PTC devices 100 are then cut from the metal sheets using any conventional mechanical or chemical cutting technique.

The device 200 is manufactured in substantially the same manner as the PTC device 100 with a few differences. First, the first and second electrodes 204 and 206 are joined during the manufacturing process by the first side electrode 226 and the second side electrode 232. This is performed by mechanically punching two holes in the device 200 to form the first recess 228 and the second recess 234. The recesses 228 and 232 are then plated with the first side electrode 226 and the second side plate 232 respectively to join the first portion 216 to the second portion 218 of the first electrode 204 and to join the third portion to the second portion 222 of the second electrode 206. Second, the device 200 is etched in a different direction to form the skive marks 240 and 242. It must be noted that the side electrodes 226,232 can also be formed directly from the nickel-coated copper sheet by bending portions of the sheet across the resistor element 102 to connect the electrodes, instead of using separate side plates.

The device 300 is manufactured in substantially the same manner as the device 200, except that the location of the first and second recesses 326 and 338 differs and the location of the first and second skive marks 332 and 334 differs.

To form the assembly 500, the PTC devices 300A and 300B are secured to the terminal 400 in the orientation described above in any suitable manner that permits electrical contact between the PTC devices 300A/300B and the terminal 400, such as soldering. During the manufacturing process, a clip or web (not shown) can be inserted within the circular opening 409 to hold the first and second terminal positions 402 and 404 into position before the devices PTC 300A and 300B are attached to the terminal 400.

The assembly 600 is manufactured in substantially the same manner as the assembly 500. The PTC devices 604A–604D are manufactured in substantially the same manner as the PTC devices 300 are except that the electrodes 614 and 616 are sized and orientated differently. The PTC devices 604A and 604B are secured in electrical contact with each other through soldering, or any other suitable technique, in the orientation described above. Further, the combination of the PTC devices 604A and 604B, as well as the PTC devices 604C and 604D, are secured in electrical contact with the terminal 602 in the orientation described above using any suitable technique, such as soldering. To hold the first and second terminal portions 606 and 608 into position during the manufacturing process, the terminal portions 606 and 608 are supported by a suitable mount at the first and second through holes 610 and 612. The completed assembly 600 can then be installed in a suitable electronic device through electrical contact at the first and second terminal portions 606 and 608 with the power system of the electronic device to protect the device against excessive electrical currents.

The devices 100, 200, 300, 500, and 600 can be used in a variety of different electronic devices to protect the devices from excessive electrical currents. For example, the devices 100, 200, 300, 500, and 600 can be used in window lift motors, seat motors, sun roof motors, door lock motors, and trunk pull down motors, or any device that requires protection from excessive currents.

As set forth above, the present invention provides for improved PTC devices having areas of effective resistance ER that encompass the majority of the PTC resistor element to lower the resistance of the PTC devices. To further lower the resistance of the PTC devices, many of the devices include multiple areas of effective resistance ER that are electrically in parallel with each other. Multiple PTC devices can be joined via a terminal to provide a PTC circuit protector assembly of even further decreased resistance.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A circuit protection device comprising:

a polymeric resistor element that undergoes changes to its electrical resistance in response to temperature, said resistor element having a first surface and a second surface;

a first electrode in electrical contact with said first surface; and a second electrode in electrical contact with said second surface;

said first electrode and said second electrode in electrical connection with each other by way of said polymeric resistor element;

said polymeric resistor element has a first area of effective resistance and a second area of effective resistance, said first area of effective resistance is electrically in parallel with said second area of effective resistance;

wherein said first and said second areas of effective resistance combine to comprise more than about half of said polymeric resistor element.

2. The circuit protection device of claim 1, wherein said polymeric resistor element comprises a polyolefin material and carbon black particles.

3. The circuit protection device of claim 1, wherein said polymeric resistor element has a first electrical resistance at first temperatures and a second electrical resistance at second temperatures, said second temperatures being higher than said first temperatures, said first resistance being lower than said second resistance.

4. The circuit protection device of claim 1, wherein at least one of said first electrode and said second electrode is a nickel coated copper foil electrode.

5. The circuit protection device of claim 1, wherein at least one of said first electrode and said second electrode include a terminal.

6. The circuit protection device of claim 1, wherein said first area of effective resistance is between a first portion of said first electrode and a first portion of said second electrode.

7. The circuit protection device of claim 1, wherein said second area of effective resistance is between a second portion of said first electrode and a second portion of said second electrode.

8. The circuit protection device of claim 1, wherein said first electrode comprises:

a first portion in contact with said first surface of said resistor element;

a second portion in contact with said second surface of said resistor element;

wherein said second electrode comprises:

a first portion in electrical contact with said first surface of said resistor element; and a second portion in electrical contact with said second surface of said resistor element;

wherein said first area of effective resistance is between said first portion of said first electrode and said first portion of said second electrode;

wherein said second area of effective resistance is between said second portion of said first electrode and said second portion of said second electrode.

9. The circuit protection device of claim 8, wherein said first portion and said second portion of said first electrode are electrically connected by a first side electrode and said first portion and said second portion of said second electrode are electrically connected by a second side electrode, said first electrode and said second electrode span a thickness of said resistor element.

10. The circuit protection device of claim 1, wherein a plurality of said circuit protection devices are electrically joined in parallel.

11. The circuit protection device of claim 10, wherein said plurality of said circuit protection devices are electrically joined in parallel on a terminal.

12. A circuit protection device comprising:

a polymeric resistor element that changes its electrical resistance in response to temperature changes and has an upper surface, a lower surface, a first end, and a second end opposite said first end;

a first electrode having:

a first portion in electrical contact with said upper surface proximate to the first end;

a second portion in electrical contact with said lower surface proximate to the second end;

a second electrode having:

a first portion in electrical contact with said lower surface proximate to the first end;

a second portion in electrical contact with said upper surface proximate to the second end;

wherein said first portion of said first electrode opposes and is in electrical contact with said first portion of said second electrode;

wherein said second portion of said first electrode opposes and is in electrical contact with said second portion of said second electrode;

wherein said first and said second portions of said first electrode are electrically connected to one another by a first side electrode positioned between said first end and said second end of said resistor element; and wherein said first and said second portions of said second electrode are electrically connected to one another by a second side electrode positioned between said first end and said second end of said resistor element.

13. The circuit protection device of claim 12, wherein said polymeric resistor element comprises a polyolefin material and carbon black particles.

14. The circuit protection device of claim 12, wherein said polymeric resistor element has a first resistance at low temperatures and a second resistance at higher temperatures, said first resistance being lower than said second resistance.

15. The circuit protection device of claim 12, wherein said circuit protection device includes:

a first effective area of resistance between said first portion of said first electrode and said first portion of said second electrode; and a second area of effective resistance between said second portion of said first electrode and said second portion of said second electrode;

wherein said first area of effective resistance is electrically in parallel with said second area of effective resistance.

16. The circuit protection device of claim 12, wherein at least one of said first side electrode and said second side electrode are separate components electrically joined to said first electrode and said second electrode respectively.

17. The circuit protection device of claim 12, wherein a plurality of said circuit protection devices are joined electrically in parallel.

18. The circuit protection device of claim 12, wherein said plurality of said circuit protection devices are joined electrically in parallel by a conductive terminal.

19. A circuit protection device comprising:

a polymeric resistor element that changes resistance in response to temperature changes, said resistor element having an upper surface, a lower surface, a first end, and a second end opposite said first end;

a first electrode in electrical contact with said upper surface and extending from at least about said first end to at least about said second end;

a second electrode in electrical contact with said lower surface;

a first side electrode at said first end and electrically connected to said first electrode and said second electrode;

a third electrode in electrical contact with said lower surface and extending from at least about said first end to at least about said second end;

a fourth electrode in electrical contact with said upper surface;

a second side electrode between said first end and said second end and electrically connected to said third electrode and said fourth electrode;

wherein said circuit protection device has a first effective area of resistance and a second effective area of resistance that is electrically in parallel with said first effective area of resistance.

20. The circuit protection device of claim 19, wherein said first and said second areas of effective resistance include a majority of said polymeric resistor element.

21. The circuit protection device of claim 19, wherein said polymeric resistor element comprises a polyolefin material and carbon black particles.

22. The circuit protection device of claim 19, wherein said polymeric resistor element has a first resistance at low temperatures and a second resistance at higher temperatures, said first resistance being lower than said second resistance.

23. The circuit protection device of claim 19, wherein at least one of said first electrodes, said second electrode, said third electrode, and said fourth electrode is a copper coated foil electrode.

24. The circuit protection device of claim 19, wherein said first area of effective resistance is at a portion of said polymeric resistor element between said first electrode and said second electrode.

25. The circuit protection device of claim 19, wherein said second area of effective resistance is at a portion of said polymeric resistor element between said third electrode and said fourth electrode.

26. The circuit protection device of claim 19, wherein a plurality of said circuit protection devices are electrically joined in parallel.

27. The circuit protection device of claim 26, wherein said plurality of said circuit protection devices are joined in parallel using a terminal.

28. A method for producing a circuit protection device having a resistor element that conducts electricity through a first area of effective resistance and a second area of effective resistance that is electrically in parallel with said first area of effective resistance, said first and said second areas of effective resistance combine to comprise more than about half of said polymeric resistor element, comprising:

forming a polymeric resistor element that changes resistance in response to environmental changes to have an upper surface and a lower surface;

positioning a first electrode in electrical contact with said upper surface and said lower surface; and positioning a second electrode in electrical contact with said upper surface and said lower surface.

* * * * *

UNITED STATES PATENT AND TRADEMARK OFFICE

CERTIFICATE OF CORRECTION

PATENT NO. : 7,119,655 B2
APPLICATION NO. : 10/999291
DATED : October 10, 2006
INVENTOR(S) : Jared Starling and Donald G. Cunitz It is certified that error appears in the above-identified patent and that said Letters Patent is hereby corrected as shown below:

Column 17,
Line 14, claim 23, “electrodes” should be --electrode--.

Signed and Sealed this

Twenty-fifth Day of December, 2007

JON W. DUDAS
*Director of the United States Patent and Trademark Office*